United States Patent [19]

Hasegawa et al.

[11] 4,117,790

[45] Oct. 3, 1978

[54] AUTOMATIC SEWING MACHINE

[75] Inventors: Yoshio Hasegawa, Machida; Koji Hiroyama, Gifu; Minoru Shimada; Haruhiko Kawasaki, both of Sagamihara, all of Japan

[73] Assignee: Kayaba Industry Co., Ltd., Tokyo, Japan

[21] Appl. No.: 793,856

[22] Filed: May 4, 1977

[30] Foreign Application Priority Data

May 4, 1976 [JP] Japan ..... 51/51204

[51] Int. Cl.[2] ..... D05B 27/14

[52] U.S. Cl. ..... 112/205; 112/121.15

[58] Field of Search ..... 112/203, 204, 205, 153, 112/121.11, 121.12, 2, 121.15, 121.24, 214; 271/225, 272

[56] References Cited

U.S. PATENT DOCUMENTS

| | | | |
|---|---|---|---|
| 709,311 | 9/1902 | Eves | 112/214 |
| 3,669,048 | 6/1972 | Dunn et al. | 271/272 X |
| 3,722,441 | 3/1973 | Kitchener et al. | 112/205 |
| 3,750,186 | 7/1973 | Sakamoto | 112/121.12 X |
| 4,013,025 | 3/1977 | Marforio | 112/121.15 |
| 4,019,447 | 4/1977 | Blessing et al. | 112/204 X |

*Primary Examiner*—Peter Nerbun

*Attorney, Agent, or Firm*—Wenderoth, Lind & Ponack

[57] ABSTRACT

An automatic sewing machine includes means for advancing a work piece having a plurality of contiguous edges connected together in angular relationship to each other to sew such edges in succession, a table supporting the workpiece and having an arcuate side face along which the workpiece is guided, and a feed mechanism provided below the table along the arcuate side face for frictional engagement with a portion of the workpiece which hangs from the table. The feed mechanism is driven to turn the workpiece in such a manner that when a first edge of the workpiece has been sewn, a second edge of the workpiece contiguous to said first edge is aligned with the advancing or feed direction of the workpiece.

7 Claims, 28 Drawing Figures

FIG. 13A
FIG. 13B
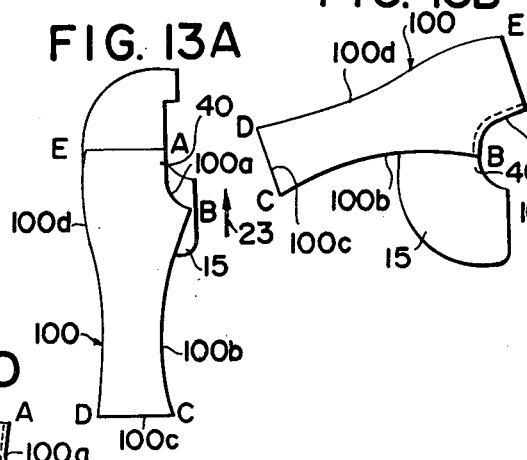
FIG.13C
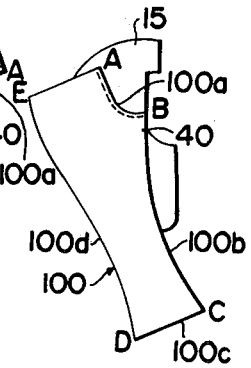
FIG.13D
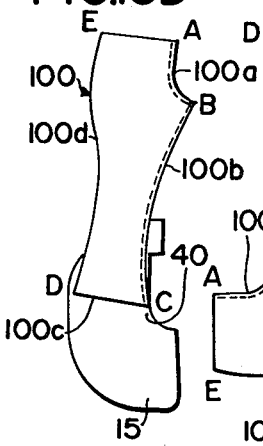
FIG.13E
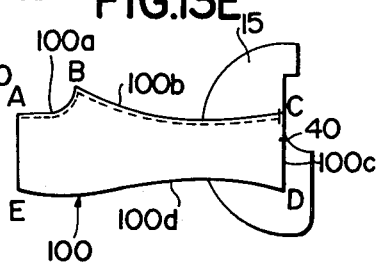
FIG.13F
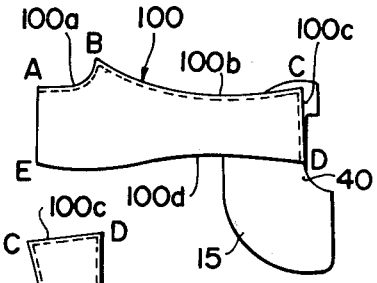
FIG.13H
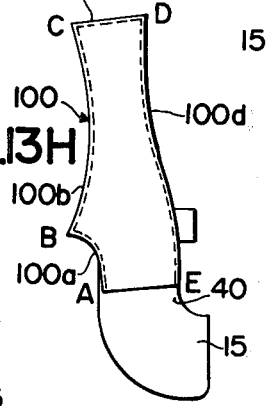
FIG.13G
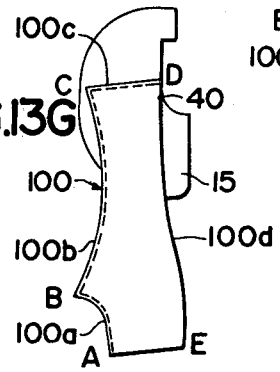

AUTOMATIC SEWING MACHINE

BACKGROUND OF THE INVENTION

This invention relates to an automatic sewing machine and more particularly, to an automatic sewing machine for continuougly sewing a workpiece having a plurality of contiguous edges connected together in angular relationship to each other.

In continuously sewing a workpiece having a plurality of contiguous edges connected together in angular relationship to each other, such as a pair of trousers, after a first edge of the workpiece has been sewn, in order to sew a second edge of the workpiece it is necessary to turn the workpiece about the position of the sewing needle so as to align the second edge with the advancing or feed direction of the work.

One of the conventional methods for turning the workpiece in the manner mentioned hereinabove has been illustrated in U.S. Pat. No. 3,425,369, for example. According to this prior art turning method, after a first edge of the workpiece has been sewn, a vertically movable turning member is lowered down onto a portion of the workpiece which hangs from the tabe to hold the workpiece portion against the surface of the table, the turning member is turned with the workpiece portion held against the table surface, and the workpiece is turned about the position of the sewing needle on the table until a second edge of the workpiece contiguous to the first edge thereof is detected by a detection means which is adapted to detect whether or not the second edge is aligned with the sewing or work advancing direction. However, in the conventional workpiece turning method, since the turning member is designed to turn the workpiece by a predetermined angle while holding the workpiece in a predetermined position or constant distance from each of the workpiece edges, there is the disadvantage that the turning member can not positively engage the workpiece portion inwardly of a second edge of the workpiece when the member turns to the workpiece after a first edge of the workpiece has been sewn. That is, generally, since a plurality of contiguous edges of a workpiece are not in constant angular relationships, or have varying angular relationships to each other, the turning member tends to engage the workpiece in a position excessively inwardly of a particular edge of the workpiece and in a position excessively outwardly of another edge of the same workpiece. That is, it can not be assured that the turning member always engages the workpiece in a predetermined constant distance from all the edges of the workpiece. When the turning member engages the workpiece at a position excessively inwardly of an edge of the workpiece, the edge is caused to crease and thus, even if the creased edge can be aligned with the work sewing or feed direction, a satisfactory or proper sewing operation can not be performed at such an edge. On the other hand, when the turning member engages the workpiece at a position excessively outwardly of a edge of the workpiece with the contact face of the turning member maintained nonparallel to the surface of the table, the turning member can not positively hold the workpiece edge and tends to disengage from the workpiece while the workpiece is being turned, whereby the workpiece edge can not be brought to the alignment with the work sewing or feed direction. In order to eliminate such disadvantages, it has been proposed to construct the turning member so as to have a sufficiently large size and cause its contact face to maintain a parallel relationship to the surface of the table. But even with such a turning member, there are still the disadvantages that a crease or creases develop in the edge of the workpiece and the edge can not be positively held down.

Furthermore, in the prior art method mentioned hereinabove, in the waiting position of the turning member, if the turning member is positioned in a position insufficiently spaced from the table surface during a sewing cycle, the turning member is contacted by a crease or creases developed in the workpiece edge to impede the sewing operation. And when the turning member is again moved to the workpiece holding-down position at a location insufficiently spaced from the table surface for the next workpiece turning operation after one workpiece turning operation, the turning member comes into contact with the crease or creases in the workpiece edge to the degree that the sewing result will be unsatisfactory. For this reason, it is necessary that the turning member has to be positioned at an otherwise unnecessarily great distance from the table surface. This appreciably prolongs the time required for the workpiece holding-down operation by the turning member and renders the construction of the turning member complicated.

SUMMARY OF THE INVENTION

Therefore, the object of the present invention is to provide an automatic sewing machine which can effectively eliminate all the disadvantages inherent in the prior art machines.

One principal object of the present invention is to provide an automatic sewing machine whereby the workpiece can be positively and rapidly turned as the edges of the workpiece are successively sewn.

Another principal object of the present invention is to provide an automatic sewing machine in which while the workpiece is being turned or sewn, the edge opposite to the edge of the workpiece which is now being sewn can be manipulated in such a manner that the turning or sewing operations can be accelerated, whereby the sewing and turning operations can be positively performed.

Another principal object of the present invention is to provide an automatic sewing machine in which the sewing operation can be precisely performed by advancing the workpiece in such a manner as not to develop any crease or creases in the workpiece during the sewing operation.

Another principal object of the present invention is to provide an automatic sewing machine which has a turning means which is simple in construction and which is easy to operate.

Another principal object of the present invention is to provide an automatic sewing machine in which during the turning of the workpiece, the workpiece is positively held in a predetermined position without developing any crease or creases in the workpiece to thereby precisely and positively turn the workpiece.

Another principal object of the present invention is to provide an automatic sewing machine in which while one edge of the workpiece is being sewn, the edge portion opposite to the first edge can be automatically manipulated, thus eliminating manual effort, to thereby improve the operation efficiency.

In order to attain the above objects, in a preferred embodiment of the present invention, the turning means comprises a drive extending below the table along a portion of the periphery of the table, and the drive belt is adapted to frictionally engage a portion of the workpiece which hangs from the table. The drive belt cooperates with the edge of the workpiece opposite to the edge thereof which is being sewn to advance and manipulate the workpiece so as to turn the workpiece after the completion of the sewing operation to thereby align the edge contiguous to the sewn edge with the sewing or advancing direction of the workpiece.

The above and other objects and attendant advantages of the present invention will be more readily apparent to those skilled in the art from a reading of the following detailed description in conjunction with the accompanying drawings which show one preferred embodiment of the present invention for illustration purposes only, but not for the purpose of limiting the scope of the same in any way.

BRIEF DESCRIPTION OF THE DRAWINGS

FIGS. 13A through 13H are plan views showing the fabric piece of FIG. 11 in successive stages in a sewing cycle on the automatic sewing machine of the invention.

PREFERRED EMBODIMENT OF THE INVENTION

Figure 11:
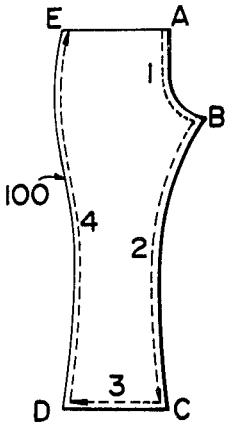
FIG. 11 is a plan view of the fabric piece for one of a pair of trousers as articles to be sewn.
Figure 12:
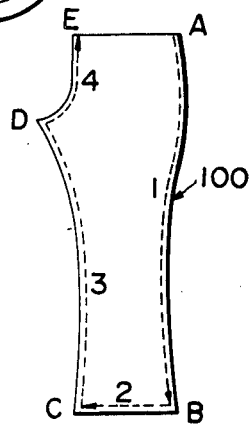
FIG. 12 is a plan view of the fabric piece for the other of the pair of trousers as articles to be sewn.

The present invention will now be described referring to the accompanying drawings and more particularly, to FIGS. 1 and 2 thereof in which the automatic sewing machine of the present invention which is adapted to continuously sew the edges of a pair of trousers as articles to be sewn as shown in FIGS. 11 and 12 is shown. The sewing machine generally comprises a framework 10, a main motor 11, a spool holder means 13 and a bead 14. The framework 10 is provided with a table 15 on which the workpiece 100 to be sewn is placed. The sewing machine also includes an automatic work guide means or manipulator 16 which cooperates with a conventional pressure bar (not shown) to regulate the positions of the edges of the workpiece to be sewn to desired or proper positions and guide the workpiece so that the workpiece can always be sewn in predetermined or desired areas by the sewing needle (not shown) which extends from the head 14. The automatic work guide means may be the same construction as shown in U.S. application Ser. No. 772,340, assigned to the assignee of the present application for example. That is, the guide means comprises a stopper member 18 mounted on the table 15 and adapted to mechanically restrain the displacement of a particular edge of the workpiece to be sewn in the inward direction from a proper position or a control position as shown by the arrow 17 in FIG. 3 (in the direction in which the distance from the particular edge to the sewing line increases), a detection means 20 adapted to detect the displacement of the particular edge of the workpiece now being sewn in the reverse direction (arrow 19) or in the outward direction from the control position, and a work feed control means 21 adapted to move the particular edge of the workpiece in the inward direction in response to signals from the detection means 20 until the particular workpiece edge reaches its predetermined proper position.

Figure 3:
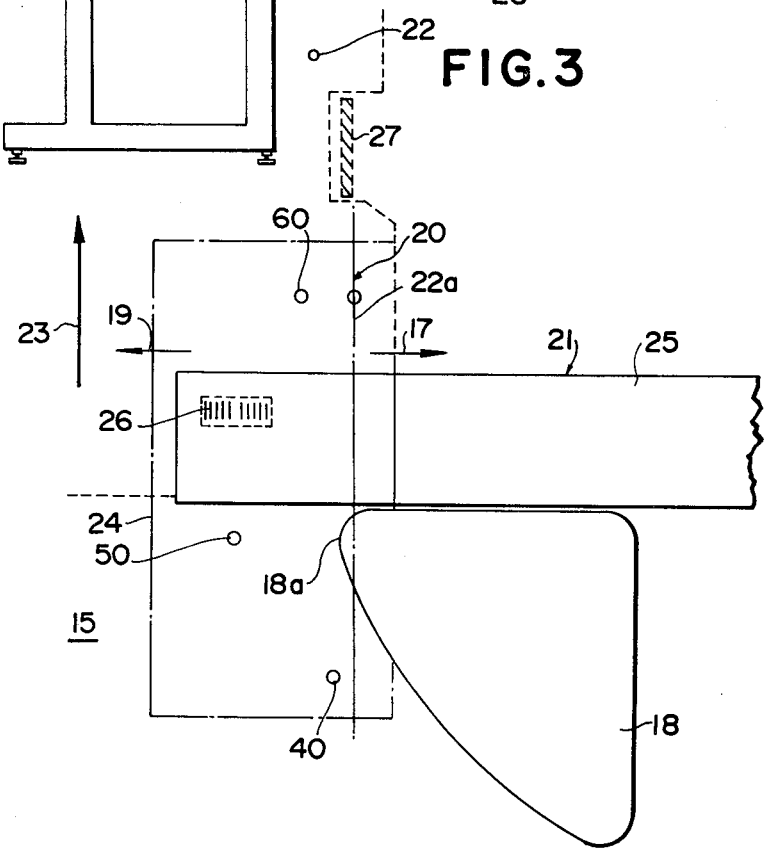
FIG. 3 is a fragmentary plan view on an enlarged scale of the detection means of the sewing machine.

The stopper member 18 is positioned in the position in which the work contacting portion **18*a* of the stopper member is slightly positioned inwardly of the properly positioned edge 22*a* of the workpiece to be sewn by a small distance upstream of the sewing needle drop point 22 in the work feed direction 23 (FIG. 3). As schematically shown in FIG. 3, the detection means 20 has a reflective plate 24 mounted on the table 15 and a luminous diode and a phototransistor (not shown) positioned above and spaced from the reflective plate for receiving the workpiece therebetween. The detection means 20 is positioned inwardly of the needle drop point 22 and the workpiece contacting portion 18*a* of the stopper member 18 with respect to the particular edge of the workpiece. The output light from the luminous diode is reflected by the reflective plate 24 to be received by the phototransistor. Thus, the presence of the workpiece on the reflective plate 24 or not is converted into an electric detection signal in the form of a difference in the input lights of the phototransistor. The feed control means 21 comprises an arm 25, a control roller 26 provided at one end of the arm 25, a motor (not shown) for driving the control roller 26 and a cylinder (not shown) for driving the arm 25 so as to cause the control roller 26 to be urged against the workpiece. Thus, the control roller 26 of the feed control means 21 is allowed to engage the workpiece on the table in response to the operation of the cylinder. With the control roller 26 engaging the workpiece, when the detection means 20 detects the absence of the workpiece on the table, the detection signal from the detection means 20 drives the motor which in turn rotates the control roller 26 in the direction in which the workpiece is pulled to be positoned below the detection means 20. When the workpiece is positioned below the detection means 20 and the detection means 20 detects the presence of the workpiece and provides a signal indicating the presence of the workpiece, the motor is braked. With the motor maintained in its braked condition, the particular edge of the workpiece to be sewn abuts against the stopper member 18 and is detered from being pulled towards the edge opposite to the particular edge of the same workpiece. In this way, the workpiece or the side edges of the workpiece to be sewn are guided in the work feed direction 23 as the workpiece position on the table is always adjusted to be properly positioned. In FIG. 3, reference numeral 27** denotes a trimming cutter.

Figure 4:
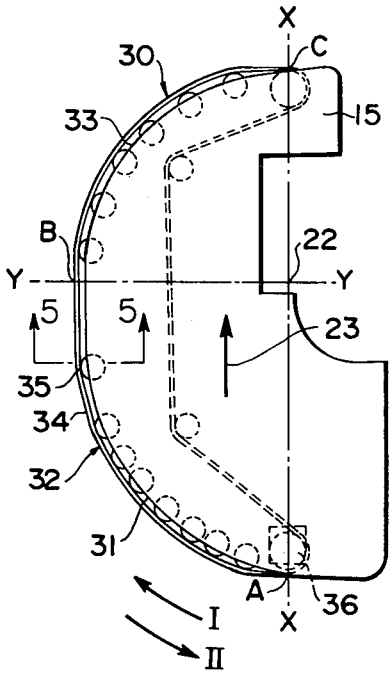
FIG. 4 is a fragmentary plan view on an enlarged scale of one embodiment of turning means to be employed in the sewing machine.
Figure 5:
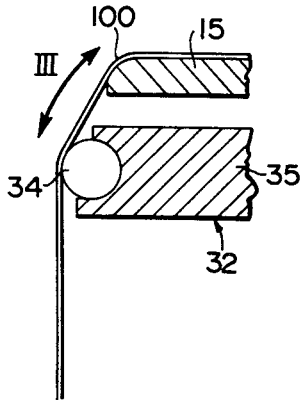
FIG. 5 is a cross-sectional view on a further enlarged scale taken substantially along line 5-5 of FIG. 4.

Now referring to FIGS. 4 through 7, there are shown two alternative turning means 30, and in the embodiment shown in FIGS. 4 and 5, the turning means comprises a table 15 having an arcuate side face 31 along which the edge of the workpiece opposite to the particular edge of the workpiece being sewn in guided, and a work feed mechanism 32 disposed below the table 15. In the embodiment shown, as will be more particularly described hereinafter, the turning means 30 cooperates with the manipulator 16 to handle the workpiece and also turns the workpiece in a desired sewing direction while the workpiece is being sewn along the edges thereof. The arcuate side face 31 of the table 15 has such an arcuate configuration that the distance of the arcuate side face from the sewing needle drop point 22 gradually decreases as the workpiece advances, whereby the workpiece can be easily handled. That is, as shown in FIG. 4, the distance of the arcuate side face 31 from the sewing needle drop point 22 gradually decreases from Point A upstream of the needle drop point 22 on the straight line X — X drawn in the work feed direction 23 through the needle drop point 22 to Point B on the line Y — Y extending through the needle drop point 22 at right angles to the line X — X. The table 15 further has a second arcuate side face 33 which has a constant distance from the needle drop point 22 from Point B to Point C on the straight line X — X downstream of the needle drop point 22 in the work feed direction.

In the illustrated embodiment, the feed mechanism 32 comprises a belt 34 guided along the arcuate side faces 31, 33 of the table 15, a plurality of guide rollers 35 provided below the table 15 adjacent to the arcuate side faces 31, 33 for guiding the belt 34 and a motor 36 driving the belt 34. As more clearly shown in FIG. 5, the belt 34 has a circular cross-section and frictionally engages a portion of the workpiece 100 which hangs from the table 15. Thus, the belt 34 is advanced in the direction of arrow I as shown in FIG. 4 by the motor 26 while the workpiece is being sewn along one edge thereof, and after the sewing of the one edge, the belt 34 is moved in the reverse direction as shown by arrow II to turn the workpiece so that the edge adjacent to the sewn edge is aligned with the work feed direction for further sewing. The turning range of the workpiece is determined by the energization time of the motor 36, for example.

Figure 7:
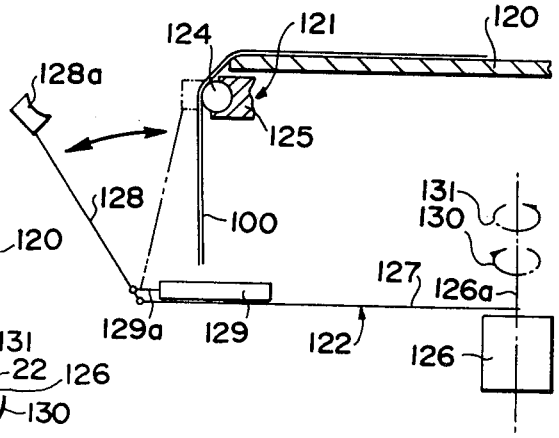
FIG. 7 is an elevational view of FIG. 6.
Figure 6:
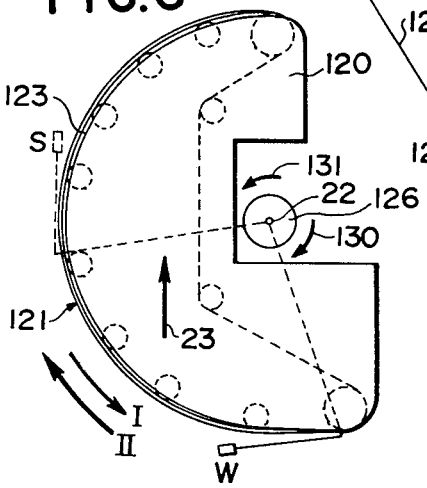
FIG. 6 is a schematic plan view of another embodiment of turning means.

According to the present invention, in order to effect positive turning of the workpiece, a holding means 122 is provided for urging the workpiece 100 against the belt as shown in FIGS. 6 and 7. The table 120 and feed turning mechanism 121 shown in FIGS. 6 and 7 are substantially identical with the table 15 and feed turning mechanism 32 of the turning means 30 referred to hereinabove, except that the entire arcuate side face 123 of the table 120 is formed as an arcuate shape having the needle drop point 22 as its center. Thus, detailed description of the table 120 and feed turning mechanism 121 of FIGS. 6 and 7 will be omitted herein. To describe the feed turning mechanism 121 briefly, the feed turning mechanism 121 has a drive belt 124 and a plurality of pulleys 125 along which the belt is guided. The holding means 122 comprises a drive motor 126 having a drive shaft **126*a* having the needle drop point 22 as its axis, a rocker arm 127 having one end secured to the drive shaft 126*a* and a pusher member 128 rockably mounted at the other end of the rocker arm 127. The pusher member 128 has a pad 128*a* at the free end or upper end, and the leading end of a piston rod 129*a* of a cylinder 129 is pivoted to the lower end of the pusher member 128. The cylinder 129 is mounted on the rocker arm 127. As the piston rod 129*a* of the cylinder 129 extends and retracts, the pusher member 128 rocks betwen the holding position in which the pad 128*a* urges the workpiece 100 against the drive belt 124, as shown in the dashed lines in FIG. 7, and the release position in which the pad 128*a* is separated from the drive belt 124 and workpiece 100 as shown in the solid line position in FIG. 7. The drive motor 126 urges the rocker arm 127 to rock in the direction 130, but effects lost motion in the reverse direction of arrow 131 as shown in FIGS. 6 and 7. In FIG. 6, the position shown by the solid line W is the waiting position of the holding means 122**, and the position shown by the dotted line S is the rocking movement initiation position of the holding member.

The drive belt 124 is driven in the direction II to manipulate the workpiece. While the work is being sewn, just before the completion of the sewing at one particular edge thereof, the rocker arm 127 is driven from the waiting position W to the rocking movement initiation position S by the drive motor 6 and reaches to the rocking movement initiation position S whereupon the sewing at the particular edge of the workpiece is completed, and at the same time, the cylinder 129 causes the pusher member 128 to rock and the pad **128*a* to urge the workpiece 100 against the drive belt 124 to thereby hold the workpiece. Thereafter, when the drive belt 124 is driven in the direction I, the rocker arm 127 is also rocked to the waiting position W while rocking the workpiece about the needle drop point 22. When the rocker arm reaches the waiting position W, the drive belt ceases its movement. By this time, the next edge of the workpiece to be sewn has been brought to the sewing position. The rocking range can be preliminarily set or can be determined by any suitable detection means. Thereafter, the pusher member is moved to the release position and the sewing of the next edge of the workpiece is initiated. This rocking arrangement is especially advantageous when a workpiece having a great length is involved. A detection means 40 (FIG. 3) controlling the operation of the feed mechanism 32 is provided and as in the case of the detection means 20, the detection means 40 comprises a luminous diode and a phototransistor (not shown) positioned above and spaced from the reflective plate 24 so as to embrace the workpiece 100 therebetween. The detection means 40 is positioned upstream of the work contacting portion 18*a* of the stopper member 18 in the work feed direction and is slightly spaced from the successively adjacent edges of the workpiece as the edges are sewn. When the workpiece is pulled to a position below the detection means 40, the detection means provides an operation command signal to the motor 36 and thus, the drive belt 34 continues to advance to feed the workpiece in the direction of arrow I (FIG. 4) so long as the workpiece is present below the detection means 40. When the workpiece is displaced from the position below the detection means 40, the motor 36** stops momentarily.

With the arrangement as mentioned hereinabove, the workpiece is guided in such a manner that the workpiece is sewn in a convex curve directed outwardly from the needle drop point 22 in the automatic guide means and in a concave curve direction inwardly from the needle point in the work turning means 30, whereby the available sewing range can be substantially increased.

When the turning means rocks in a manner as will be described hereinafter, the work turning manipulator 30 retracts to assure positive turning of the workpiece.

As shown in FIG. 3, detection means 50 and 60, similar to the detection means 20 and 40, respectively, are disposed in opposition to the reflective plate 24. The detection means 50 provides a speed reduction signal to the main motor 11 while the workpiece is being held in its stationary position and sewn in its portion having a great curvature, and the detection means 60 provides an operation command signal to a thread cutter (not shown) while the workpiece is being held in its stationary position. The detection means 60 is aligned with the detection means 20 in the work feed direction, and the detection means 50 is disposed a substantial distance upstream of the detection means 60 in the work feed direction.

Figure 8:
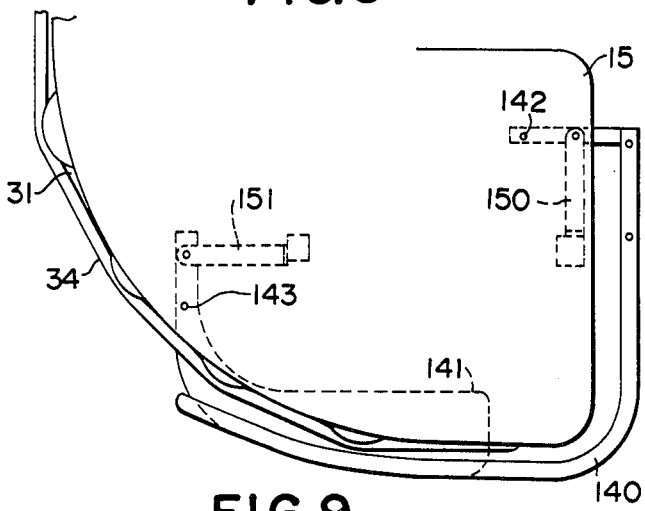
FIG. 8 is a plan view on an enlarged scale of blade means adapted to prevent a workpiece to be sewn from folding.
Figure 9:
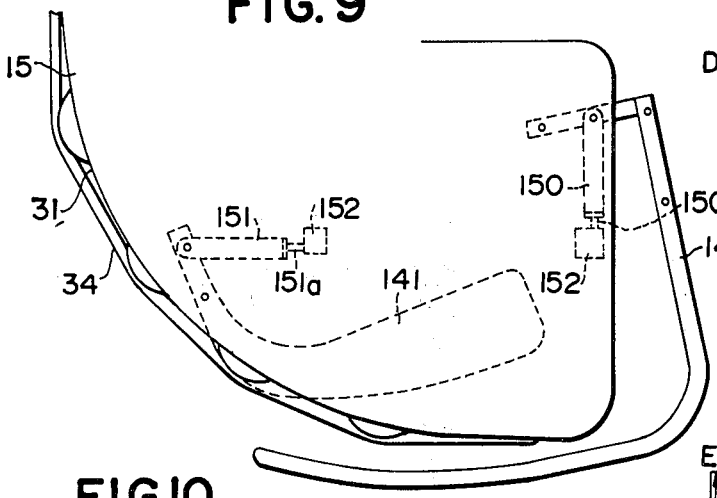
FIG. 9 is similar to FIG. 8, but shows the blade means in one operative position.
Figure 10:
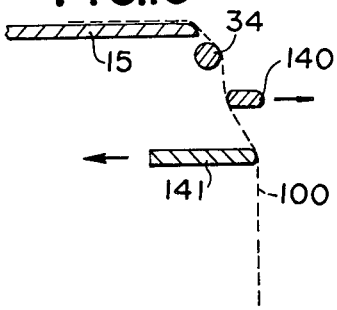
FIG. 10 is a cross-sectional view showing a workpiece to be sewn in a position embraced by the blade means.
Figure 14B:
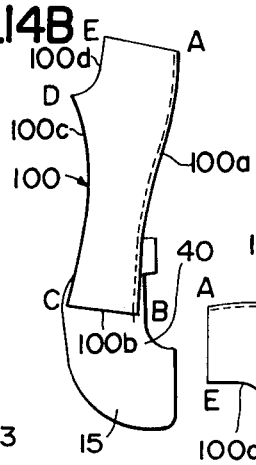
FIGS. 14A through 14H corresponding to FIGS. 13A through 13H, respectively, but show the fabric piece of FIG. 12 in successive stages in a sewing cycle on the automatic sewing machine of the invention.
Figure 14A:
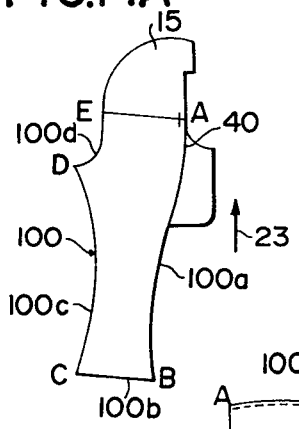
Figure 14C:
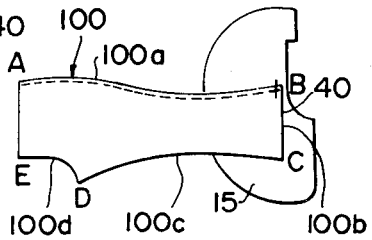
Figure 14D:
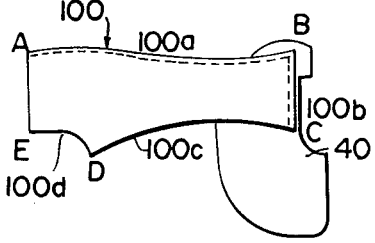
Figure 14E:
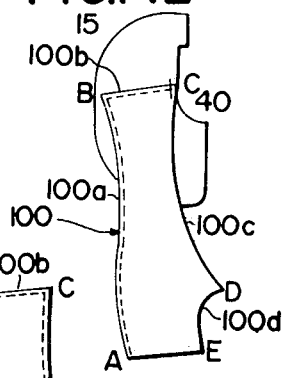
Figure 14F:
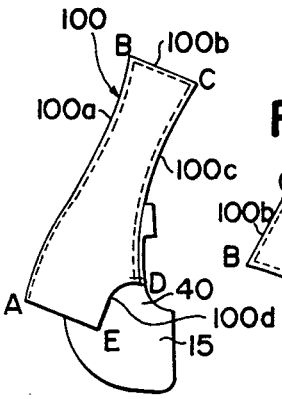
Figure 14G:
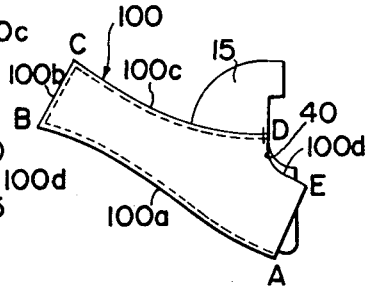
Figure 14H:
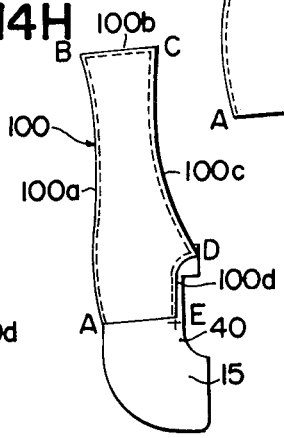

Referring now to FIGS. 8 through 10, a pair of work folding prevention blades 140, 141 are provided on the work feed or receiving side of the table 15. As more clearly shown in FIG. 10, the blades 140, 141 are disposed in a vertically spaced relationship below the drive belt 34. The upper blade 140 is adapted to make contact with the outer surface of the portion of the workpiece 100 which hangs from the table 15, and the base end of the blade 140 is pivoted to the table 15 by means of a pivot pin 142. The lower blade 141 is positioned for making contact with the inner surface of the workpiece and is pivoted at its base end to the table 15 by means of a pivot pin 143. Thus, it will be noted that the upper and lower blades 140, 141 are disposed to embrace the workpiece on the outer and inner surfaces thereof (FIG. 10). In order to pivot the two blades 140, 141 to bring them into contact with the workpiece and to disengage them from the workpiece, the blades are provided with drive cylinders 150, 151, respectively. The drive cylinders 150, 151 are pined at their base ends to the respectively corresponding blades and have piston rods 150*a*, 151*a*, respectively, therein, the base ends of which are secured to blocks 152, 152 extending from the table 15. These drive cylinders 150, 151 have return springs (not shown) therein and the springs are adapted to normally urge their associated pistons rods 150*a*, 151*a* into the retracted position within the associated drive cylinders 150, 151 when the cylinders are in the non-operative positions as shown in FIG. 8. In the non-operative positions of the drive cylinders, the blades 140, 141 grip the workpiece 100 to shear off the workpiece as shown in FIGS. 8 and 10. That is, the upper blade 140 urges the workpiece against the belt 34 and the lower blade 141 urges the workpiece against the upper blade.

The two drive cylinders 150, 151 operate in the same manner as a cylinder (not shown) which moves the pressure bar for the sewing machine upwardly and downwardly. More particularly, during a cycle of sewing operation on the workpiece, the drive cylinders 150, 151 are maintained in their non-operative positions and the blades 150, 151 hold the workpiece in position in the manner as mentioned hereinabove whereby the blades 140, 141 draw the workpiece lightly to remove any fold or folds and/or crease or creases so that the workpiece can be fed in its flattened state into the sewing machine. On the other hand, during the waiting and pivotal movement of the blades 140, 141, the drive cylinders 150, 151 operate to extend their associated piston rods 150*a*, 151*a* against the force of the return springs therein. For this purpose, the blades 140, 141 pivot about their pivot pins 142, 143 in the direction away from the workpiece and each other as shown in FIG. 9 to provide a clearance therebetween so that a new workpiece to be sewn can be easily inserted into the clearance between the blades.

The automatic sewing machine referred to hereinabove operates in the following automatic sewing sequence. Before the workpiece to be sewn is set in position for sewing, the pressure bar is held in its raised position and the blades 140, 141 are maintained in their released or open positions as shown in FIG. 9. With the pressure bar and blades maintained in the positions mentioned above, the workpiece is moved into the clearance between the blades and then set in a desired or proper sewing position in the sewing machine whereupon the pressure bar descends down onto the workpiece to hold the workpiece down, and at the same time the blades 140, 141 are pivoted toward each other to grip the work therebetween. Thereafter, a cycle of sewing operation on the sewing machine is initiated. The blades 140, 141 maintain their closed position to grip the workpiece therebetween during the time period from the start to the completion of the sewing cycle. At the completion of the sewing cycle, the pressure bar rises, and at the same time the blades 140, 141 pivot away from each other to release the workpiece from between them to allow a new workpiece to be inserted into the clearance between the blades. Thereafter, the pressure bar descends down onto the new workpiece and the blades 140, 141 pivot toward each other to hold the workpiece in position for sewing in cooperation with the pressure bar, and the next sewing cycle is initiated on the new workpiece.

In the automatic sewing machine of the present invention, the workpiece can be fed in its crease-free state into the sewing machine so that a precise sewing operation can be performed and the workpiece can be properly and efficiently set without requiring any skilled operator.

Figure 1:
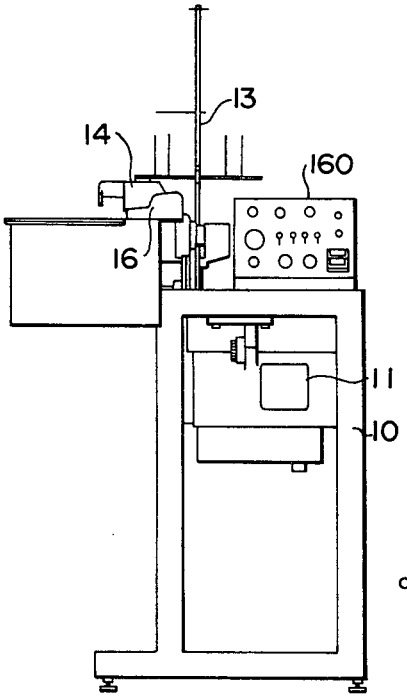
FIG. 1 is a front elevational view of one preferred embodiment of an automatic sewing machine constructed in accordance with the present invention.
Figure 2:
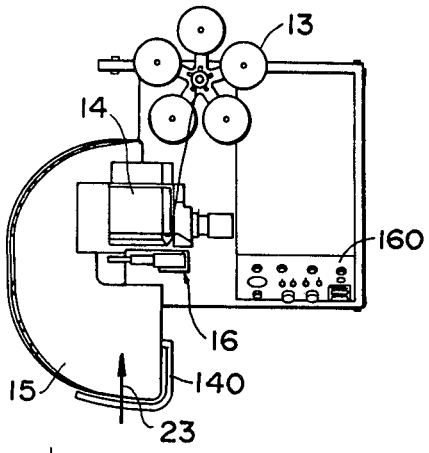
FIG. 2 is a plan view of the sewing machine of FIG. 1.

The entire operation of the automatic sewing machine can be controlled by a control board 160 mounted on the framework 10 (FIG. 1).

The operation of the automatic sewing machine of the present invention will be now described in connection with edge-sewing on a fabric piece patterned after the body of a trouser. The fabric piece for the body of one of a pair of trousers is shown by 100 in FIG. 11, and the fabric piece for the body of the other of the pair of trousers is shown by 100 in FIG. 12. The first fabric piece is sewn in accordance with the sequences A, B, C and D as shown in FIGS. 13A through 13H, and the second fabric piece is sewn in accordance with the similar sequence A, B, and C and D as shown in FIGS. 14A through 14H.

In operation, the workpiece 100 is manually fed into the sewing machine to a desired or proper sewing position by the operator and all the detection means detect the presence of the workpiece whereupon the sewing operation is initiated. During the sewing operation, the detection means 20, 40 detect the edges of the workpiece for any deviation of the position of the workpiece, and if a deviation of the proper position is detected the manipulator 16 and belt 34 are driven to correct the positon deviation. Thus, the workpiece is moved about in accordance with the particular cut configuration of the workpiece so that a first edge 100*a* of the workpiece 100 to be sewn (extending between Points A and B) in an initial stage of the sewing operation may be positioned in the sewing position below the sewing needle, whereby the trimming operation by a trimming cutter for removing a portion from the workpiece which makes the workpiece unshapely as is necessary in the conventional sewing machine can be eliminated. As the operation progresses along the first edge 100*a* extending from Point A to Point B on the workpiece, and Point B clears the detection means 50 which in turn provides a signal indicating "non-presence of work", the main motor 11 reduces its rotational rate as preparation for stoppage in a proper position, and the workpiece advances according to such a rotation rate of the motor. At this time, the detection means 60 detects the passage of the workpiece end thereby and at the lapse of a predetermined time space, the workpiece ceases its advance leaving a width thereof from the edge to the seam line for hemstitching in the position below the needle which has reached its lower dead point by this time. The time after the workpiece has passed by the detection means 60 is determined by only the workpiece feed pitch and preliminarily set since the number of rotatins at the reduced rate as preparatory for stoppage in the proper position is constant. With the parts maintained in this position, the pressure bar is raised and the feed mechanism is moved backwardly to turn the workpiece so as to align the second or adjacent edge 100*b* of the workpiece 100 to be next sewn (extending between Points B and C) with the work feed direction, and the workpiece is then stopped. When the workpiece has passed by the detection means 60, the pressure bar and manipulator which were maintained in its raised position during the turning of the workpiece descend down onto the workpiece to hold the workpiece in position. Thereafter, the sewing operation is performed on the workpiece along the second edge 100*b* extending from Point B to Point C. When the detection means 40 detects the presence of the workpiece again, the belt advances to reduce the inertia force as a result of the turning movement of the workpiece because the sewing machine operates only when the workpiece is present in the detection means 40. In this way, the sewing operation progresses along the second edge 100*b* extending from Point B to Point C, the third edge 100*c* extending from Point C to Point D and along the fourth edge 100*d* extending from Point D to Point E in succession, and the thread is cut off the workpiece at Point E. The sewn product is then stacked by a stacker suitable for the product. The belt most effectively handles the first fabric piece along the first side edge extending between Points A — B, and the second fabric piece along the fourth side edge extending between Points D and E. As shown in FIGS. 14A through 14H, while the second fabric piece is being sewn along the fourth side edge extending between Points D and E, if the belt does not handle the workpiece for a rather long time, the fabric piece tends to fall down from the left-hand side of the table by the gravity of the workpiece to impede the sewing operation, the thread can not be cut off the workpiece and the product can not be stacked by the same stacker employed for stacking the product obtained from the fabric first piece. However, since the edge extending between Points D and E of the second fabric piece has an inwardly curved configuration, the workpiece is always detected by the detection means 40. Thus, the belt operates for a long time period at the particular side edge resulting in efficient handling of the workpiece. The first and second fabric pieces each has the sewing termination point at Point E which is adapted to be positioned in substantially the same position in the sewing machine, and the products obtained from the fabric pieces are orientated substantially in the same position when the sewing operation on the fabric pieces has been completed, the product obtained from the fabric pieces can be stacked by the common stacker.

The sewing operation sequence to be performed on each of the fabric pieces will be as follows:

A→B, turn, B→C, turn, C→D, turn, D→E, thread cutting and stacking.

While the invention has been described in conjunction with a specific embodiment thereof, it is to be understood that many alternatives, modifications and variations will be apparent to those skilled in the art in the light of the aforegoing description. Accordingly, it is intended that the invention embrace all such alternatives, modifications and variations which fall within the spirit and scope of the appended claims.

What is claimed:

1. An automatic sewing machine for successively sewing contiguous edges of a workpiece which extend at angles with respect to each other, said machine comprising:

a table having an upper surface for supporting a workpiece to be sewn;

a sewing needle located at a position fixed with respect to said table for sewing successive contiguous edges of the workpiece;

means for advancing the workpiece over said table in a sewing direction such that a given edge of the workpiece is maintained in a predetermined position with respect to said sewing needle;

said table having at least one arcuate side face dimensioned such that a portion of the workpiece opposite the edge thereof being sewn hangs down over and slidably engages said arcuate side face; and feed mechanism means, positioned adjacent the bottom of said table and extending substantially along the contour of said arcuate side face thereof, for frictionally engaging the portion of the workpiece hanging down over said arcuate side face of said table, and for, upon completion of sewing of one edge of the workpiece, turning the workpiece with respect to said table until the workpiece is positioned such that the next adjacent contiguous edge of the workpiece is aligned with said sewing direction.

2. A sewing machine as claimed in claim 1, wherein said feed mechanism means includes means to drive said workpiece in said sewing direction in cooperation with said advancing means during sewing of an edge of said workpiece.

3. A sewing machine as claimed in claim 1, further comprising holding means, rotatably mounted about said fixed sewing needle position, for releasably urging the portion of the workpiece hanging down over said arcuate side face against said feed mechanism means and for holding the hanging workpiece portion against said feed mechanism means during turning of the workpiece with respect to said table.

4. A sewing machine as claimed in claim 1, wherein said arcuate side face of said table has an arcuate configuration such that the distance between said arcuate side face and said fixed sewing needle position gradually decreases in the direction of advancement of the workpiece during sewing thereof.

5. A sewing machine as claimed in claim 1, wherein said arcuate side face of said table has a uniform curvature about said fixed sewing needle position.

6. A sewing machine as claimed in claim 1, wherein said feed mechanism means comprises a belt positioned adjacent the bottom of said table and extending along said arcuate side face thereof, and means for guiding and driving said belt in a path along said arcuate side face.

7. A sewing machine as claimed in claim 6, further comprising folding prevention means for preventing the workpiece from being folded or creased, said folding prevention means comprising a pair of blades positioned below said belt at a location adjacent the workpiece receiving side of said table, said blades being disposed on opposite sides of the hanging workpiece portion so as to embrace such workpiece portion, and said blades being pivotally mounted for movement toward and away from such workpiece portion.

* * * * *